US005603804A

United States Patent [19]

Hansen et al.

[11] Patent Number: 5,603,804

[45] Date of Patent: Feb. 18, 1997

[54] PROCESS FOR PRODUCTION OF LINERBOARD AND CORRUGATED MEDIUM

[75] Inventors: Tomas T. Hansen, Alleroed; Hans C. Holm, Gentofte, both of Denmark; Neal E. Franks, Newtown, Conn.

[73] Assignee: Novo Nordisk A/S, Bagsvaerd, Denmark

[21] Appl. No.: 599,285

[22] Filed: Feb. 9, 1996

Related U.S. Application Data

[63] Continuation of Ser. No. 130,959, Oct. 4, 1993, abandoned.

[51] Int. Cl.[6] ..... D21H 21/18

[52] U.S. Cl. ..... 162/158; 162/147; 162/182; 162/100

[58] Field of Search ..... 162/72, 158, 161, 162/9, 78, 100, 182, 147; 435/278; 264/505

[56] References Cited

U.S. PATENT DOCUMENTS

| | | | |
|---|---|---|---|
| 3,644,167 | 2/1972 | Mowry | 161/125 |
| 3,966,543 | 6/1976 | Cayle et al. | 162/158 |
| 4,478,683 | 10/1984 | Orndorff | 162/161 |
| 4,830,708 | 5/1989 | Paice et al. | 162/72 |
| 4,923,565 | 5/1990 | Fuentes et al. | 162/1 |
| 4,980,023 | 12/1990 | Salkinoja | 162/135 |
| 5,110,412 | 5/1992 | Fuentes et al. | 162/72 B |
| 5,147,793 | 9/1992 | Johnson et al. | 435/156 |
| 5,149,648 | 9/1992 | Nishida et al. | 435/192 |
| 5,169,497 | 12/1992 | Sarkar et al. | 162/158 |
| 5,304,330 | 4/1994 | Tatarchuk et al. | 264/61 |

FOREIGN PATENT DOCUMENTS 5247865 9/1993 Japan .

OTHER PUBLICATIONS

ISSN: 0099–2240 Addleman et al Pulp & Paper PQ H9R 3J9 Can Appl Environ Microbiol (1993) 59(1) 266–73.

Johnson et al Derwent Abstract for U.S. Pat No 5178762.

*Primary Examiner*—Peter Chin

*Attorney, Agent, or Firm*—Steve T. Zelson, Esq.; Elias J. Lambiris, Esq.

[57] ABSTRACT

This invention relates to a process for producing linerboard or corrugated medium.

17 Claims, No Drawings

PROCESS FOR PRODUCTION OF LINERBOARD AND CORRUGATED MEDIUM

This application is a continuation of application Ser. No. 08/130,959, filed Oct. 4, 1993 now abandoned, the contents of which are incorporated herein by reference.

TECHNICAL FIELD

This invention relates to a process for producing linerboard or corrugated medium.

BACKGROUND ART

Linerboard and corrugated medium, used for making corrugated paperboard and corrugated cartons, are commonly made from a suspension of unbleached chemical or semichemical pulp or pulp from recycled fibers.

Typically, the pulp is treated in a screening process, refined, then mixed with paper making additives in the stock preparation section before the pulp suspension is dewatered on the paper/board machine, and the drained water (so-called white water) is recycled back into the process for dilution of the screened stock.

The white water will normally contain high amounts of wood fibers/fines, sterol esters, resin acids, lignans, and lignin fragments typically in concentrations of 100–500 ppm or higher; all of this material will have phenolic or phenol like groups. The high amount of lignin fragments carries a significant anionic charge which makes it uneconomical to use traditional strength agents, and the high amounts of trash in the white water furthermore cause significant effluent problems for the mills.

Strength, particularly compression strength, is an important mechanical property of the unbleached board grades used to make corrugated boxes: linerboard and corrugated medium. In the United States, recent changes to "Rule 41—governing transportation containers" have given an alternative specification based on combined board edge crush, since combined edge crush can be tied directly to the compression strength of the board's components it is now possible to sell board on a performance per square meter basis rather than only by weight.

It is an object of this invention to provide a process for producing linerboard or corrugated medium having improved mechanical strength.

STATEMENT OF THE INVENTION

We have found that, surprisingly, the strength of the linerboard/corrugated medium can be increased by treating the pulp suspension with a phenol-oxidizing enzyme system in the stock preparation section prior to the paper machine. It is believed that this strengthening is due to cross-linking of the lignin present at the surface of the individual pulp fibers.

Accordingly, the invention provides a process for producing linerboard or corrugated medium, comprising:

(a) preparing a suspension of unbleached chemical or semichemical pulp or pulp from recycled fibers, (b) treating the pulp suspension with a phenol oxidizing enzyme system, and (c) dewatering the treated pulp in a paper making step to remove process water and produce the linerboard or corrugated medium, wherein no beating or refining of the pulp occurs during or after step (b).

In a preferred embodiment, the process water from step (c) is recycled, and step (a) comprises dilution of the pulp with the recycled process water. Advantageously, the enzymatic treatment of the pulp and white water suspension will to a large extent polymerize the aromatic materials present in the white water (lignans, resin acids, sterol esters, lignin-like compounds, fibers and fines) so that they are retained in the paper sheet, leading to an increased yield and a decreased COD (chemical oxygen demand) load and toxicity of the effluent. Said polymerization is also believed to contribute to strengthening of the linerboard or corrugated medium.

The invention also provides a process for making corrugated paperboard or corrugated boxes using the linerboard or corrugated medium produced by the above process.

EP 429,422 discloses reduction of energy consumption in the refining stages by use of laccase during pulp preparation between the first and second refining stage; the document indicates that some increase of paper strength is also obtained. However, in the process of this invention there is no beating after the enzyme treatment and such reduction of the energy consumption is therefore not achieved.

EP 433,258 discloses a procedure for improving the strength properties of mechanical pulp by using an enzymatic treatment, e.g. with laccase or peroxidase, to link a binding agent (e.g. a carbohydrate or protein) to lignin. U.S. Pat. No. 4,687,745 discloses a process for enhancing the strength properties and brightness stability of mechanical pulp by treating the pulp with ligninolytic enzymes. EP 433,258 and U.S. Pat. No. 4,687,745 relate only to mechanical pulp, not to (semi)chemical pulp or pulp from recycled fibers, as used in this invention.

DETAILED DESCRIPTION OF THE INVENTION

Pulp

The pulp to be used in the process of the invention is a suspension of unbleached chemical or semichemical pulp or pulp from recycled fibers. The chemical pulp may be unbleached kraft pulp, and the semichemical pulp may be NSSC (neutral sulfite semichemical) pulp. The pulp from recycled fibers may particularly be made from OCC (old corrugated containers) or ONP (old news print).

The preparation of the pulp suspension may comprise beating or refining of the pulp, depending e.g. on the type of pulp.

Phenol oxidizing enzyme system

The enzyme system used in the invention consists of a suitable oxidase together with $O_2$ or of a suitable peroxidase together with $H_2O_2$. Suitable enzymes are those which oxidize and polymerize aromatic compounds such as phenols and lignin.

Examples of suitable enzymes are catechol oxidase (EC 1.10.3.1), laccase (EC 1.10.3.2), bilirubin oxidase (EC 1.3.3.5) and peroxidase (EC 1.11.1.7). The peroxidase may be derived from a strain of Coprinus, e.g. *C. cinerius* or *C. macrorhizus*, or of Bacillus, e.g. *B. pumilus*, from soy bean or horse radish. The laccase from Trametes, e.g. *T. versicolor* (also called Polyporus, e.g. *P. pensitus*). It may be preferable to use two different phenol oxidizing enzymes together.

The amount of peroxidase should generally be in the range 10–10,000 PODU per g of dry substance (PODU unit of peroxidase activity defined below). The amount of laccase should generally be in the range 10–10,000 units per g of dry substance (unit of laccase activity defined below).

Molecular oxygen from the atmosphere will usually be present in sufficient quantity. A suitable amount of $H_2O_2$ will usually be in the range 0.01–10 mM, particularly 1–10 mM.

Process conditions

The enzyme treatment can be done at conventional consistency, e.g. 0.5–25% (particularly 0.5–10%) dry substance, at temperatures of 20°–90° C. and a pH of 4–10.

Determination of peroxidase activity (PODU)

Peroxidase activity is determined from the oxidation of 2,2'-azinobis(3-ethylbenzothiazoline-6-sulfonate) (ABTS) by hydrogen peroxide. The greenish-blue color produced is photometered at 418 nm. The analytical conditions are 0.88 mM hydrogen peroxide, 1.67 mM ABTS, 0.1M phosphate buffer, pH 7.0, 30° C., 3 minutes reaction.

1 peroxidase unit (PODU) is the amount of enzyme that catalyses the conversion of 1 μmol hydrogen peroxide per minute at these conditions.

Determination of laccase activity

Laccase activity was determined by a similar method without addition of hydrogen peroxide. 1 unit of laccase activity was defined as the amount of enzyme that catalyses the oxidation of 1 μmol ABTS per minute.

EXAMPLE

A Kraft liner pulp is dissolved in 0.1M buffer (Britton-Robinson buffer consisting of boric acid, phosphoric acid, and acetic acid) at pH 5.5, corresponding to a dry solid content of 2.5%. A laccase from *Polyporus pinsitus* is added to a concentration of 528 laccase units/g dry pulp. The mixture is shaken in a water bath at 50° C. for 2 hours. Subsequently a paper hand sheet is made from the pulp in a laboratory hand sheet former. The sheet is subsequently pressed and dried in a rapid sheet dryer. The tear- and tensile index of the paper sheet is measured.

The above can also be carded out using process water (white water) instead of buffer.

We claim:

1. A process for producing linerboard or corrugated medium, comprising:

(a) preparing a suspension of unbleached chemical or semichemical pulp or pulp from recycled fibers, (b) treating the diluted pulp with oxygen and a laccase in an amount of 10–50,000 units per gram of dry matter, and (c) dewatering the treated pulp in a paper making machine to remove process water and produce the linerboard or corrugated medium, wherein no beating or refining of the pulp occurs during or after step (b).

2. The process according to claim 1, wherein at least a part of the process water from step (c) is recycled, and step (a) comprises dilution of the pulp with the recycled process water.

3. The process according to claim 1, wherein the laccase treatment is performed at a consistency of 0.5–25%, a pH of 4–10 and a temperature of 20°–90° C.

4. The process according to claim 1, wherein the pulp is unbleached kraft pulp, neutral sulfite semichemical pulp, or recycled pulp from old corrugated containers or old news print.

5. A process for producing a corrugated paperboard or corrugated container, comprising producing a linerboard and/or corrugated medium by the process according to claim 1, and combining the linerboard and corrugated medium to produce the corrugated paperboard or corrugated container.

6. The process according to claim 1, wherein the laccase is a Polyporus laccase.

7. The process according to claim 6, wherein the laccase is a *Polyporus pinsitus* laccase.

8. A process for producing linerboard or corrugated medium, comprising:

(a) preparing a suspension of unbleached chemical or semichemical pulp or pulp from recycled fibers, (b) treating the diluted pulp with oxygen and a catechol oxidase in an amount of 10–50,000 units per gram of dry matter, and (c) dewatering the treated pulp in a paper making machine to remove process water and produce the linerboard or corrugated medium, wherein no beating or refining of the pulp occurs during or after step (b).

9. The process according to claim 8, wherein at least a part of the process water from step (c) is recycled, and step (a) comprises dilution of the pulp with the recycled process water.

10. The process according to claim 8, wherein the catechol oxidase treatment is performed at a consistency of 0.5–25%, a pH of 4–10 and a temperature of 20°–90° C.

11. The process according to claim 8, wherein the pulp is unbleached kraft pulp, neutral sulfite semichemical pulp, or recycled pulp from old corrugated containers or old news print.

12. A process for producing a corrugated paperboard or corrugated container, comprising producing a linerboard and/or corrugated medium by the process according to claim 8, and combining the linerboard and corrugated medium to produce the corrugated paperboard or corrugated container.

13. A process for producing linerboard or corrugated medium, comprising:

(a) preparing a suspension of unbleached chemical or semichemical pulp or pulp from recycled fibers, (b) treating the diluted pulp with oxygen and a bilirubin oxidase in an amount of 10–50,000 units per gram of dry matter, and (c) dewatering the treated pulp in a paper making machine to remove process water and produce the linerboard or corrugated medium, wherein no beating or refining of the pulp occurs during or after step (b).

14. The process according to claim 13, wherein at least a part of the process water from step (c) is recycled, and step (a) comprises dilution of the pulp with the recycled process water.

15. The process according to claim 13, wherein the bilirubin oxidase treatment is performed at a consistency of 0.5–25%, a pH of 4–10 and a temperature of 20°–90° C.

16. The process according to claim 13, wherein the pulp is unbleached kraft pulp, neutral sulfite semichemical pulp, or recycled pulp from old corrugated containers or old news print.

17. A process for producing a corrugated paperboard or corrugated container, comprising producing a linerboard and/or corrugated medium by the process according to claim 13, and combining the linerboard and corrugated medium to produce the corrugated paperboard or corrugated container.

* * * * *